US010065761B2

(12) United States Patent
Kansburg

(10) Patent No.: US 10,065,761 B2
(45) Date of Patent: Sep. 4, 2018

(54) CARTON CONFIGURED WITH DUAL OPENING CAPABILITIES

(71) Applicant: Intercontinental Great Brands LLC, East Hanover, NJ (US)

(72) Inventor: Mark Kansburg, East Hanover, NJ (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 0 days.

(21) Appl. No.: 15/505,569

(22) PCT Filed: Aug. 24, 2015

(86) PCT No.: PCT/US2015/046505
§ 371 (c)(1),
(2) Date: Feb. 21, 2017

(87) PCT Pub. No.: WO2016/032942
PCT Pub. Date: Mar. 3, 2016

(65) Prior Publication Data

US 2017/0267395 A1 Sep. 21, 2017

Related U.S. Application Data

(60) Provisional application No. 62/042,748, filed on Aug. 27, 2014.

(51) Int. Cl.
*B65D 5/06* (2006.01)
*B65D 5/54* (2006.01)

(52) U.S. Cl.
CPC ..... *B65D 5/068* (2013.01); *B65D 5/5425* (2013.01); *B65D 5/5445* (2013.01); *B65D 5/067* (2013.01); *B65D 5/54* (2013.01)

(58) Field of Classification Search
CPC .... B65D 5/068; B65D 5/5425; B65D 5/5445; B65D 5/067; B65D 5/54; B65D 47/36; B65D 5/542
(Continued)

(56) References Cited

U.S. PATENT DOCUMENTS 2,333,123 A 11/1943 Ringler
3,109,577 A 11/1963 Knipp
(Continued)

FOREIGN PATENT DOCUMENTS

EP 442179 8/1991
EP 1329391 7/2003
(Continued)

OTHER PUBLICATIONS

International Preliminary Report on Patentability, dated, Feb. 28, 2017, for International Application No. PCT/US2015/046505 (6 pgs.).
(Continued)

*Primary Examiner* — Christopher Demeree
(74) *Attorney, Agent, or Firm* — Fitch, Even, Tabin & Flannery LLP

(57) ABSTRACT

A dual-opening carton has a front, rear, and opposing side panels. A flap extends over the top of the carton, allowing the top to be opened and re-closed. A score line extends around the carton to facilitate the removal of a top portion of the carton. The score line has segments extending along the front panel, the rear panel, and rear portions of the side panels that have a relatively low cut length to land length ratios that maintain relatively high structural integrity. The score line also has segments extending along the front of the side panels have a relatively high cut length to land length ratio to facilitate tear propagation. The score line extending along the side panels is angled so that a pull force vector
(Continued)

removing the top portion of the carton runs along a plane generally parallel to the score line.

20 Claims, 3 Drawing Sheets

(58) Field of Classification Search
USPC .... 229/244, 241, 235, 125.42, 101.2, 123.2, 229/213, 216, 240, 243, 249
See application file for complete search history.

(56) References Cited

U.S. PATENT DOCUMENTS

| | | | | |
|---|---|---|---|---|
| 3,467,298 | A | 9/1969 | Wysocki | |
| 3,620,439 | A * | 11/1971 | Morse | B65D 5/5445 206/438 |
| 4,915,235 | A | 4/1990 | Roosa | |
| 5,634,556 | A * | 6/1997 | Focke | B65D 85/1045 206/268 |
| 5,653,384 | A * | 8/1997 | Shaikh | B65D 5/5425 229/145 |
| 6,073,833 | A | 6/2000 | Desrosiers | |
| 6,422,454 | B1 | 7/2002 | Barr | |
| 6,435,351 | B1 | 8/2002 | Gibb | |
| 7,658,318 | B2 | 2/2010 | Walsh | |
| 7,891,543 | B2 | 2/2011 | Abel | |
| 7,959,060 | B2 | 6/2011 | Wilson | |
| 7,988,034 | B2 | 8/2011 | Pezzoli | |
| 8,752,708 | B2 | 6/2014 | Keefe | |
| 8,833,638 | B2 | 9/2014 | Pezzoli | |
| 2008/0296360 | A1 | 12/2008 | Abel | |
| 2010/0078467 | A1 | 4/2010 | Mortimore | |

FOREIGN PATENT DOCUMENTS

| | | |
|---|---|---|
| FR | 2767511 | 2/1999 |
| FR | 2928349 | 9/2009 |
| JP | H08253238 | 10/1996 |
| JP | H1059356 | 3/1998 |
| JP | 10230927 | 9/1998 |
| JP | H10230927 | 9/1998 |
| JP | 2002002682 | 1/2002 |
| JP | 2002012223 | 1/2002 |
| JP | 2006027660 | 2/2006 |
| JP | 2007253984 | 10/2007 |
| JP | 2007276861 | 10/2007 |
| WO | 2006124156 | 11/2006 |
| WO | 2008013742 | 1/2008 |
| WO | 2008042834 | 4/2008 |

OTHER PUBLICATIONS

International Search Report, dated Nov. 2, 2015 for International Application No. PCT/US2015/046505 (3 pgs.).
Written Opinion of the International Searching Authority for International Application No. PCT/US2015/046505 (5 pgs.).
Notification of the First Office Action, dated Apr. 2, 2018 in Chinese Application No. 201580044393.9 and English Translation (13 pgs).

* cited by examiner

CARTON CONFIGURED WITH DUAL OPENING CAPABILITIES

CROSS REFERENCE TO RELATED APPLICATIONS

This application is a U.S. national phase application of International Application No. PCT/US2015/046505, filed Aug. 24, 2015, which claims benefit from U.S. Provisional Application No. 62/042,748, filed Aug. 27, 2014, which are each hereby incorporated herein by reference in their entirety.

FIELD

Gable top cartons are described herein, and, in particular, gable top cartons with dual opening capabilities.

BACKGROUND

Gable top cartons are used to package consumer products. Gable top cartons generally have a rectangular base with two opposing gable panels coupled together at the top of the package. Some gable top cartons are openable at the top, such as disclosed in U.S. Pat. No. 2,333,123. For example, some packages can be opened by separating a portion of one of the gable panels, such as disclosed in U.S. Pat. No. 7,891,543. Once the gable panels are separated, the contents of the package can be removed or dispensed through the opening. Some gable top cartons are configured to allow the entire top portion of the carton to be partially removed, such as disclosed in U.S. Patent Publ. 2010/0078467.

Cartons that have both an opening at the top and a removable top portion can allow a user to select a preferred method for opening the carton. Depending on the intended use of the carton and/or the contents stored therein, a user may prefer one method of opening over another. Incorporating both of these features into a single carton, however, can present difficulties. For example, incorporating a score line that facilitates removal of the entire top portion can undesirably weaken the carton. These weakened areas can present issues when the carton bears a compressive load, such as when stacked during shipment or while on display in a retail environment. While score lines can be configured to improve the structural integrity by limiting the amount of weakness on the score line, limiting the weakness of the score line typically makes it more difficult to tear the carton along the score line.

SUMMARY

The exemplary cartons described herein and depicted in the figures employ lines of weakness (e.g., score lines) configured to facilitate the dual-opening nature of the gable top carton while also maintaining sufficient structural carton integrity. A user may be able to either employ the top-opening feature of the carton or the top-removal feature of the carton as desired. Further, the described cartons can have a structural integrity that allows cartons to withstand a compressive load, such as when the cartons are stacked upon one another, without causing the cartons on the bottom of the stack to collapse, break, or tear in an undesired fashion. These benefits can be achieved, for example, by varying the force required to tear or rupture among different lines of weaknesses or segments of lines of weaknesses. For instance, the varying the average ratio of cut length to land length of a perforation, score pattern, or other such line of weakness (e.g., the cut/land ratio) or depth or depths of a thinned die line of weakness at various locations about the carton, strategically placing cuts and lands at certain locations based on the carton geometry, providing sections that facilitate the initial breaking or puncture of the score line, strategically angling the score line with respect to the geometry of the carton, and/or providing crease lines in the carton to weaken one or more of the panels after initial rupturing of one panel to facilitate further tearing of other panels can be used alone or in various combinations to facilitate opening of the carton.

In some aspects, the lines of weakness can be configured so that certain portions employ a stronger configuration (e.g., by employing a smaller cut/land ratio, i.e., by using larger lands, smaller cuts, or a combination thereof), whereas other portions employ an easier tearing or rupturing configuration (e.g., by employing a larger cut/land ratio, i.e., using smaller lands, larger cuts, or a combination thereof). The stronger configurations may be employed along certain portions of the carton that are likely to experience high levels of stress, tension, compression, or other force. Thus, the stronger configurations add structural integrity to the carton. The easier tearing or rupturing configurations may be employed along regions that are more difficult to tear, such as along non-straight portions of the score line.

The carton can include a front panel, a rear panel opposite the front panel, and first and second side panels each extending between the front and rear panels. The carton can further include a flap at a top of the front panel that is attached to the rear panel to close a top end of the carton. The flap can be at least partially detachable from the rear panel along one or more flap lines of weakness in order to permit a user to open the top end of the carton to access contents of the carton. The carton can also include a pattern of panel lines of weakness extending about the front, rear first side and second side panels. The pattern can be configured to be ruptured to permit a top portion of the carton to be either partially removed, such as if it remains hingedly attached, or completely removed to access contents of the carton. The pattern can include one or more first side panel lines of weakness extending toward the front panel and toward the rear panel. The pattern can also include a line of weakness in each of the front and rear panels and aligned with ends of the first side panel lines of weakness. The lines of weakness in each of the front and rear panels can be inclined, such that each is closer to the top of the carton adjacent the second side panel as compared to adjacent to the first side panel. The line of weakness in each of the front and rear panels is configured to require a lower force to rupture as compared to the one or more first side panel lines of weakness. This advantageously can allow the carton to better withstand compressive loads while facilitating ease of opening.

The carton can also include a starter line of weakness extending around at least a portion of a periphery of a starter portion in the first side panel; and wherein the one or more first side panel lines of weakness can be a pair of first side panel lines of weakness, one extending from adjacent one end of the starter line of weakness toward the front panel and the other extending from adjacent the other end of the starter line of weakness toward the rear panel. The starter line of weakness can optionally be configured to require a lower force to rupture as compared to the pair of first side panel lines of weakness. The starter line of weakness can optionally be configured to require a lower force to rupture as compared to the inclined line of weakness in each of the front and rear panels.

The pattern of panel lines of weakness can optionally be formed from a series of cuts and lands.

In another aspect, the carton can include a front panel, a rear panel opposite the front panel, and first and second side panels each extending between the front and rear panels. A flap at a top of the front panel can be folded over and attached to the rear panel to close a top end of the carton. The flap can be at least partially detachable from the rear panel along one or more flap lines of weakness to open the top end of the carton to access contents of the carton. A pattern of panel lines of weakness formed from a series of cuts and lands extends about the front, rear, first side and optionally the second side panels. The pattern is configured to be broken to permit a top portion of the carton to be at least partially removed to access contents of the carton. The pattern can include a starter line of weakness extending around at least a portion of a periphery of a starter portion in the first side panel. The pattern also include a pair of first side panel lines of weakness, one of which extends from adjacent one end of the starter line of weakness toward the front panel and the other of which extends from adjacent the other end of the starter line of weakness toward the rear panel. The pattern can also include an inclined line of weakness in each of the front and rear panels, where the inclined lines of weakness each are closer to the top of the carton adjacent the second side panel as compared to adjacent the first side panel.

In any of the foregoing aspects, the first side panel can have a pair of crease lines, with one of the crease lines extending from adjacent one end of the starter line of weakness toward the top of the carton and the other of the crease lines extending from adjacent the other end of the starter line of weakness. The crease lines configured to facilitate flexing of the front and rear panels toward each other during removal of the top portion of the carton.

In any of the foregoing aspects, the starter line of weakness can define a semi-circular edge of the starter portion. The starter portion can be pushed inwardly by a user with a finger in order to form an opening. The user can then use the opening to separate the top portion of the carton.

In any of the foregoing aspects, a cut of the pattern can extend across an intersection of the front and first side panels, and another cut of the pattern extends across an intersection of the rear and first side panels. The cuts can facilitate tearing along the pattern from the first side panel to the front and rear side panels.

In any of the foregoing aspects, the inclined lines of weakness can each be straight lines inclined toward the top of the carton by an angle of greater than 15 degrees, between about 15 and 25 degrees, or between about 18 and 19 degrees.

In any of the foregoing aspects, each of the pair of first side panel lines of weakness can be inclined toward the top of the carton and away from the starter line of weakness.

In any of the foregoing aspects, the second side panel can have a second side panel line of weakness such that the pattern permits the top portion of the carton to be removed. However, the second side panel line of weakness can be omitted or configured such that tearing is optional, such as if it is desired to have the top portion hinged to the remainder of the carton. Thus, the second side panel can alternatively be configured such that the top portion of the carton remains attached by the second side panel to the remainder of the carton upon separation along the pattern.

In any of the foregoing aspects utilizing cuts and lands, An average length of the cuts of each of the pair of first side panel lines of weakness can be less than an average length of the cuts of each of the inclined lines of weaknesses. An average length of the cuts of the starter portion line of weakness can be greater than the average length of the cuts of each of the inclined lines of weaknesses. The length of the cuts of each of the inclined lines of weakness can be greater adjacent the first side panel as compared to the second side panel.

In any of the foregoing aspects utilizing cuts and lands, each of the pair of first side panel lines of weakness can have a first average ratio of lands to cuts, the starter line of weakness can have a second average ratio of lands to cuts, and each of the inclined lines of weakness can have a third average ratio of lands to cuts. The first, second and third ratios can each be different from one another or at least one of the others. The first ratio can be larger than the third ratio and/or the second ratio. The third ratio can be less than the first ratio. The second side panel line of weakness, if present, can have a fourth average ratio of lands to cuts, and the first and fourth ratios can be less than the third ratio and/or less than the second ratio.

A method of opening the carton can comprise opening the carton by breaking the flap line of weakness and then moving the front and rear panels away from each other at top ends thereof. Another method of opening the carton can comprise at least partially removing the top portion of the carton by propagating a tear along the pattern of lines of weakness.

DETAILED DESCRIPTION

Figure 2:
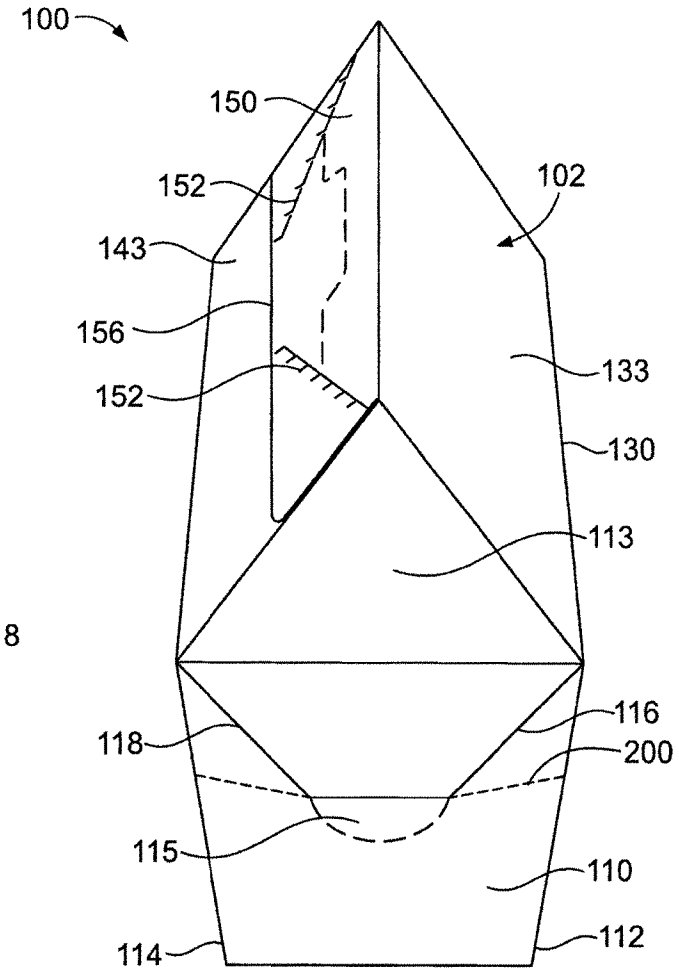
FIG. 2 is a top perspective view of the carton of FIG. 1.
Figure 3:
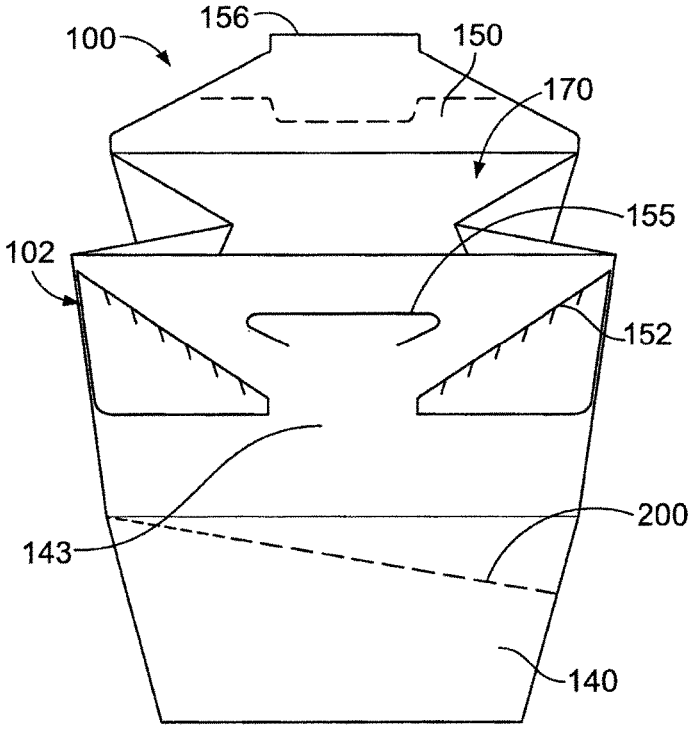
FIG. 3 is a front perspective view of the carton of FIG. 1, showing the top opened.
Figure 4:
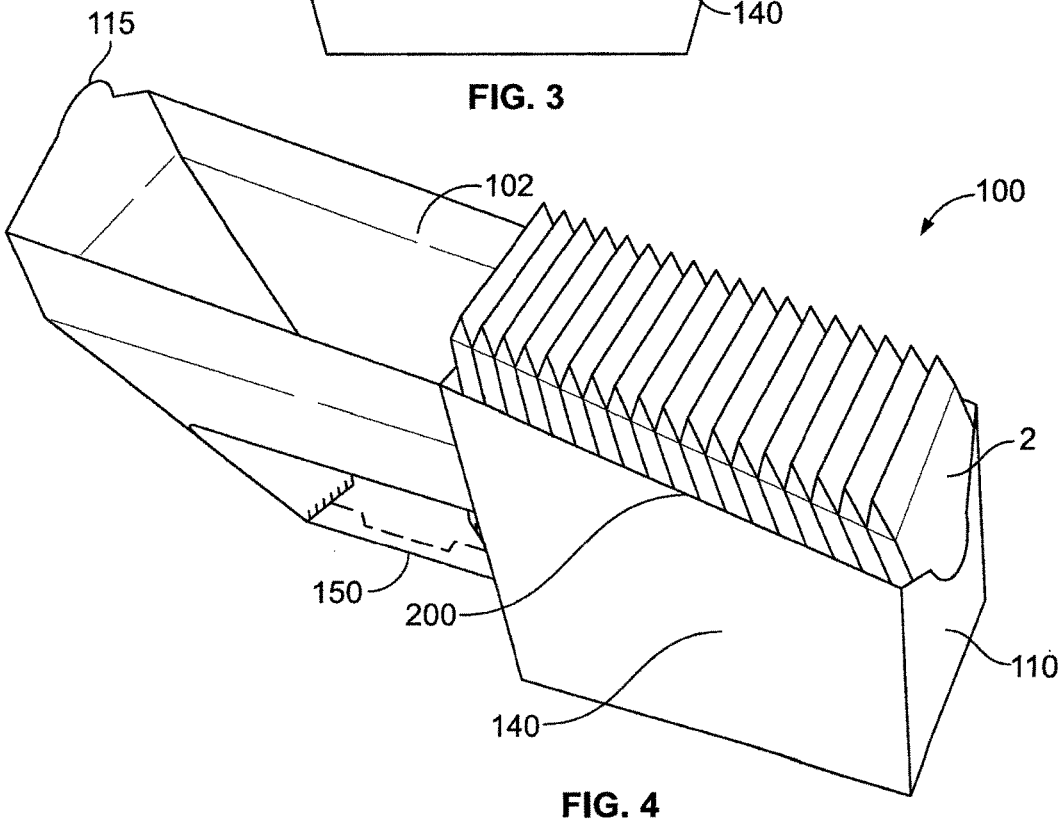
FIG. 4 is a front perspective view of the carton of FIG. 1, showing a top portion partially removed from the remainder of the carton.

The exemplary cartons described herein and depicted in FIGS. 1-5 employ lines of weakness (e.g., perforation lines) configured to facilitate the dual-opening nature of the gable top carton while also maintaining sufficient structural carton integrity. A user can open the top of the carton, as depicted in FIG. 3, or, alternatively or in addition, remove a top portion of the carton, as depicted in FIG. 4. One or more lines of weakness can optionally be used in connection with the top-opening feature, and a pattern of lines of weakness can optionally be used in connection with the top-removal feature. Improved structural integrity of the carton, particularly in compressing loading, can be achieved by varying the average ratio of cut length to land length of a perforation, score pattern, or other such line of weakness (e.g., the cut/land ratio) at various locations about the carton, strategically placing cuts and lands at certain locations based on the carton geometry, providing sections that facilitate the initial breaking or puncture of the line of weakness, strategically angling one or more of the lines of weakness with respect to the geometry of the carton, and/or providing crease lines in the carton to weaken one or more of the panels after initial rupturing of one panel to facilitate further tearing of other panels. While the exemplary carton is described as having both a top-opening feature and a top-removal feature, either one could be omitted.

Figure 1:
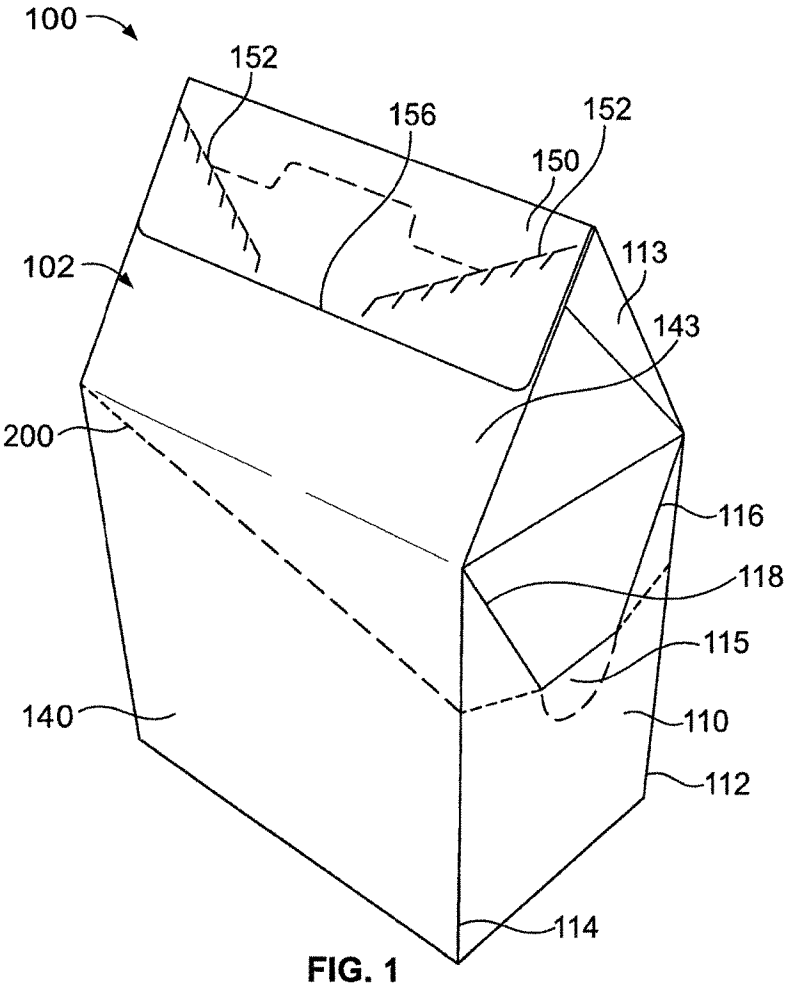
FIG. 1 is a front perspective view of an exemplary embodiment of a gable top carton configured for dual opening, showing the top closed.

Referring now to the drawings, FIGS. 1 and 2 show an example of a carton 100 and, in particular, a gable top carton having the top-opening feature and the top-removal feature. A bottom portion of the carton 100 is generally rectangular, having four sides and a bottom. A top portion 102 includes the generally triangular gable.

The carton 100 includes a front panel 140, a rear panel 130, a first side panel 110, a second side panel 120 in a rectangular arrangement. A plurality of flaps 160 together form a bottom of the carton 100. The first side panel 110 has a front first side edge 112 and rear first side edge 114. The front first side edge 112 is an intersection of the front panel 140 and the first side panel 110, and the rear first side edge 114 is an intersection of the rear panel 130 and the first side panel 110. The second side panel 120 has a front second side edge 124 and rear second side edge 122. The front second side edge 124 is an intersection of the front panel 140 and the second side panel 120, and the rear second side edge 122 is an intersection of the rear panel 130 and the second side panel 120.

The front panel 140 includes a top portion 143 than is inclined toward a top portion 133 of the rear panel 130 to form part of the gable top portion 102 of the carton 100. Creases 119 on a top portion 113 of the first side panel 110 allow the top portion 113 to fold inward and form a gusset. Similarly, creases 129 on a top portion 123 of the second side panel 120 allow the top portion 123 to fold inward and firm a gusset on an opposite side the carton as compared to the gusset of the first side panel.

To close the gable top portion 102, a flap or extension 150 of the top portion 133 of the rear panel 130 is folded to abut against the top portion 143 of the front panel 140, as shown in FIGS. 1 and 2. The flap 150 can be attached to the opposing top portion 143 via an adhesive or glue, for example. More specifically, the flap 150 can include a pair of diagonally-extending lines of weakness 152 disposed at corners of the flap 150, as illustrated in FIGS. 1 and 2. The corners of the flap 150 can be attached to the top portion 143 of the front panel 140, while the portion of the remainder of the flap 150 can be unattached. The lines of weakness 152 can be configured such that, when the perforation is broken, the remainder of the flap 150 will include a tab 156, as shown in FIG. 3. The tab 156 can facilitate re-closing of the top portion 102 after opening. For example, the tab 156 can be configured to be inserted into a corresponding slot 155 on the top portion 143 of front panel 140. Alternative ways of opening and optionally reclosing the gable top portion 102 of the carton 100 can be used. For example, a horizontal zipper strip defined between a pair of lines of weakness can be used.

As depicted in FIG. 3, the flap 150 has been cut or torn along the lines of weakness 152, thereby separating the opposing top portions 143 and 133 and establishing an opening 170. Flap 150 is shown with tab 156 projecting upwards. When a user desires to close the carton 100, flap 150 can be folded over the opposing panel so that tab 156 can be inserted into the slot 155, thereby securing the flap over the top opening 170 and closing the carton 100. The flap 150 can be secured to the opposing gable panel 143 via numerous other techniques. For example, a cold adhesive can be used to allow the flap 150 to removably attach to the top portion 143 of the front panel 140.

The first side panel 110 includes a starter 115 which can be, for example, a thumb notch. Depending on the size, shape, and configuration of the carton, the starter 115 can also vary in size and shape. In one example embodiment, the starter 115 can be a semicircle having a radius of about 13.5 mm, and positioned equidistant from the front first side edge 112 and the rear first side edge 114. The starter 115 can be configured to break and fold inward along a crease line when pressed by a user. This breaking can serve to initiate the breaking of one or more lines of weakness of the pattern 200 of panel lines of weakness, as will be described in greater detail below, in order to completely remove or partially remove the top portion of the carton 100.

The pattern 200 of lines of weakness can be formed from different perforations, including a series of cuts and lands extending around the front panel 140, rear panel 130, and first and second side panels 110 and 120 of the carton 100, and can allow for removal of the top portion 102 of the gable carton 100, as shown in FIG. 4. The top portion 102 of the carton 100 can be at least partially separated, as shown in FIG. 4, by propagating a tear along pattern 200. The removal of the top portion 102 thereby exposes the contents 2, which can be, for example, individually wrapped snacks such as biscuits, cookies, cakes, and/or other edible objects. With top portion 102 opened, upper portions contents 2 can be readily identifiable and accessed, thereby allowing a user to maintain a visual inventory of the quantity of contents 2 remaining within the carton 100.

The pattern 200 can also take on configurations that vary the length of the cuts and lands around the carton 100. More specifically, in certain aspects, the cut/land ratio (or average ratio) along the pattern 200 can increase and/or decrease at various locations around the carton 100. For example, certain lines of weakness of the pattern 200 may employ a relatively low cut/land ratio (or average ratio) with respect to other portions of the line of weakness. A line of weakness having a lower cut/land ratio (or lower average ratio) will have less cut material that has been cut, which establishes less weakness and allows that portion to provide greater structural support and integrity. Accordingly, areas that may be prone to receiving higher amounts of stress may be equipped with a line of weakness that has a relatively low cut/land ratio.

Lines of weakness with lower cut/land ratios, however, are generally more difficult to tear or rupture than lines with higher cut/land ratios, as higher cut/land ratios typically provide a weaker structure. Thus, other lines of weakness of pattern 200 can be configured with higher cut/land ratios to facilitate tearing of the package along those portions. Generally, lines of weakness with higher cut/land ratios can be employed in areas where it might otherwise be difficult to have a tear propagate along a score line. Higher cut/land ratios can be useful on lines of weakness that are difficult to pull in a direction that is generally parallel to the score line, in lines of weakness where the line extends a relatively long distance, in portions where the line does not extend in a straight line, and/or in portions that are intended to serve as the initial tearing or breaking point.

The pattern 200 can also employ portions that are angled, inclined and/or positioned so that the line of weakness follows a path that is on a plane generally parallel to or more closely aligned with the force vector generating the removal of the carton. Accordingly, certain aspects of the carton disclosed herein utilize a line of weakness pattern that generally follows the force applied to the top portion 102 of the carton 100 as it is removed. For example, because a user removing the top portion 102 will generally pull upwards from the position of the starter 115 on the first side panel 110, the tear or rupture force will generally be applied upward along the front and rear panels 130 and 140 of the carton. In this manner, some embodiments of the carton 100 may optionally employ an inclined line of weakness extending along the front and rear panels 140/130 at an angle that generally runs upward from the starter 115.

Figure 5:
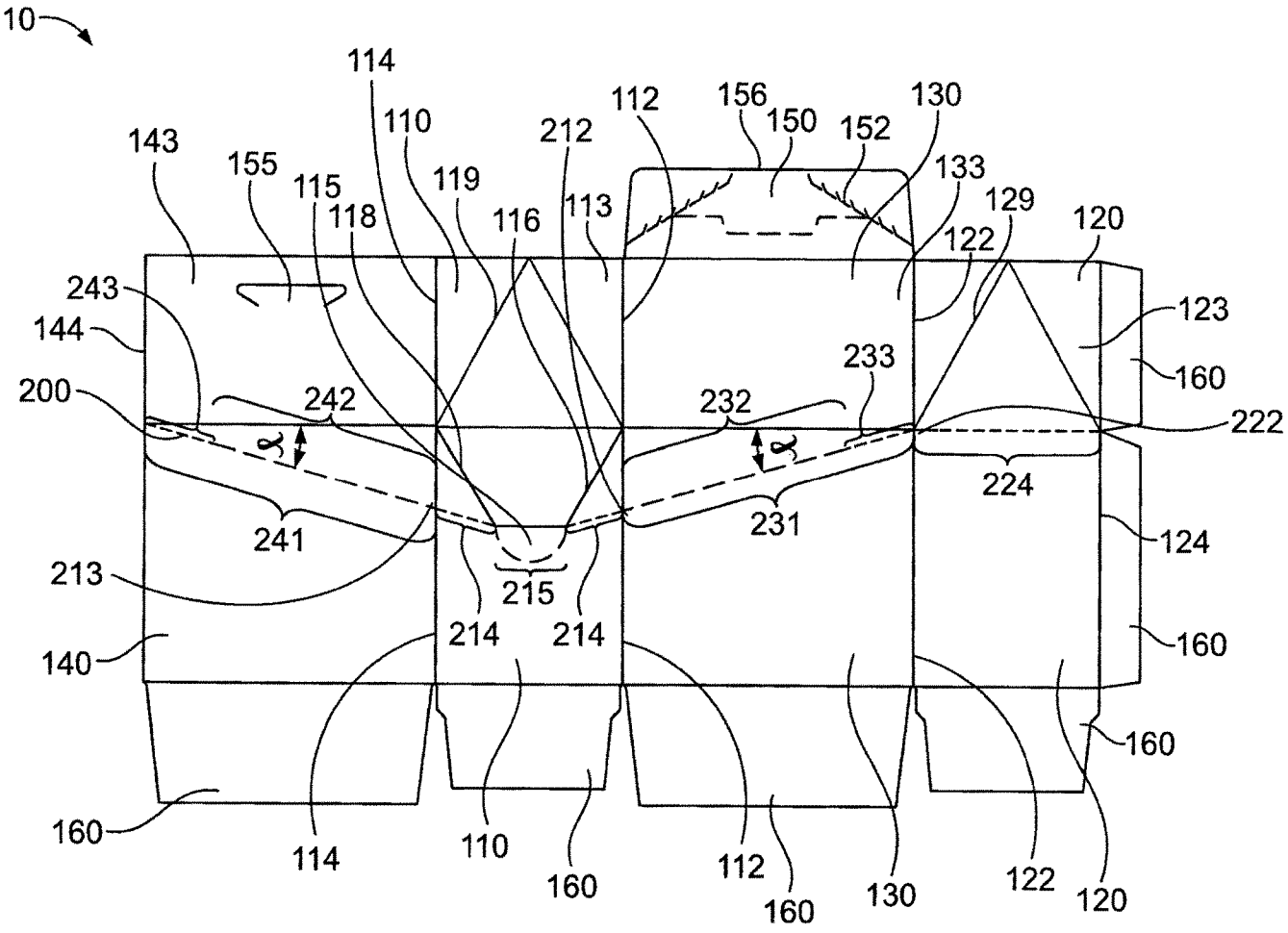
FIG. 5 is a plan view of a blank suitable for forming the carton of FIG. 1.

FIG. 5 is a plan view of a blank 10 suitable for forming a carton 100 having a with a pattern 200 line of weakness. On the first side panel 110, the pattern 200 includes a starter line of weakness 215 which comprises a series of cuts and lands extending around the periphery of starter 115. The cut/land ratio (or average ratio) of starter line of weakness 215 can be relatively high, such that the lengths of the cuts are relatively long with respect to the lengths of the lands. This relatively high cut/land ratio along starter line of weakness 215 facilitates the initial breaking of the starter 115 and the initial tearing of the pattern 200.

Adjacent to the starter line of weakness 215 are two first panel lines of weakness 214. The first side panel lines of weakness 214 can be inclined toward the top of the carton and away from the starter line of weakness 215. The cut/land ratio (or average ratio) along each of the first side panel lines of weakness is relatively small with respect to other lines of weakness of the pattern 200 (e.g., with respect to tear lines of weakness 232 and 242 and starter line of weakness 215). In one example, the length of the cuts on the front panel score lines of weakness 214 can be about 3.18 mm, and the length of the lands can be about 2 mm. In some examples, the cuts and lands can form a cut/land ratio of about 1.45 to about 1.75, or more specifically about 1.55 to about 1.65, or even more specifically, about 1.59. This relatively low cut/land ratio allows lines of weakness 214 to provide greater structural stability to the carton when assembled because lines of weakness 214 have less cut material.

In some embodiments, a cut 212 extends across the front first side edge 112 of the first side panel 110 (i.e., the intersection of the front and first side panels). Similarly, a cut 213 can extend across the rear first side edge 114 (i.e., the intersection of the rear and first side panels). Cuts 212 and 213 are configured to extend across the edges, and therefore around the corners of the carton 100. Tearing the carton 100 around corners can be difficult and can often result in a tear propagating away from the score line. Thus, cuts 212 and 213 are configured to facilitate the tear to propagate along the pattern 200 by providing a point of weakness on the corners themselves.

Extending away from the first side panel 110 along the rear panel 130 is an inclined line of weakness 231. Similarly, extending away from the first side panel 110 along the front panel 140 is an inclined line of weakness 241. In some embodiments, the inclined lines of weakness 231/241 are mirror images, and therefore contain similar and/or identical opposing features to one another. The inclined line of weakness 231 of the rear panel 130 extends from the front first side edge 112 to the front second side edge 122 of the second side panel 120. Similarly, the inclined line of weakness 241 of the front panel 140 extends from the rear first side edge 114 towards a left edge 144 of the blank 10. The inclined line of weakness 231 of the rear panel 130 extends up from the front first side edge 112, or down from the first rear edge 112 such that the inclined line of weakness 231 is closer to the top of the carton 100 adjacent the second side panel 120 as compared to adjacent the first side panel 110. The inclined line of weakness 231 extends along the rear panel 130 at an angle $\alpha$. Angle $\alpha$ represents the angle that the inclined line of weakness 231 rises above horizontal while extending away from the rear first side edge 114, or the angle that it extends below the horizontal extending from the rear second side edge 124. The angle $\alpha$ can be configured so that the angle creates a score line segment that runs either generally parallel to or more parallel with a force vector of a user lifting and removing the top portion 102 of the carton 100. In some embodiments, the angle $\alpha$ can be greater than 10° or greater than 15°, between about 10° or 15° and about 25°. The angle $\alpha$ can be between about 15° and 20°, and even more specifically, angle $\alpha$ can be from about 18° to about 19°. Because the inclined line of weakness 241 of the front panel 140 can be generally a mirror image of the inclined line of weakness 231 of the rear panel 130, the inclined line of weakness 241 of the front panel 140 may also extend away from the rear first side edge 114 at the same angle $\alpha$. In some examples, the first front side lines of weakness 214 also extend away from the starter line of weakness 215 towards the front and rear first side edges 112/114 at the same angle $\alpha$.

The inclined lines of weakness 231/241 of the pattern 200 can comprise various segments that employ multiple varying score line patterns. For example, the inclined lines of weakness 231 and 241 of the front and rear panels 140/130 can include relatively stronger, compressive lines of weakness 233/243 adjacent the second side panel 120, and relatively weaker, tear lines of weakness 232/242 adjacent the first side panel 110. In general, the compressive lines of weakness 233/234 have a smaller average length of cuts than the average length of cuts along the tear line lines of weakness 232/242. The compressive lines of weakness 233/243 can be configured to have a relatively low cut/land ratio (or average ratio) so as to provide strength and stability to that portion of the carton. In some aspects, the cut and land pattern of the compressive lines of weakness 233/243 are about the same, or similar to those of the front panel score lines of weakness 214. For example, in one example the length of the cuts on the compressive lines of weakness 233/243 can be about 3.18 mm, and the lengths of the lands are about 2 mm. In other examples, the cuts and lands can form an cut/land ratio of about 1.45 to about 1.75, or more specifically about 1.55 to about 1.65, or even more specifically, about 1.59. In some embodiments, the location of the compressive lines of weakness 233/243 corresponds to an area of the carton 100 that is likely to be subject to high levels of stress. For example, the compressive lines of weakness 233/243 may be located adjacent to the second side panel 120 of the carton 100, as that area can be subject to higher levels of stress due to stacking. Providing a segment of the stronger, i.e., more force required to rupture, compressive lines of weakness 233/243 as part of the angled score line lines of weakness 231/241 adjacent the second side panel 120 can help improve the overall strength of the carton 100 along these lines of weakness, thereby making it less likely that the carton 100 will experience unwanted tearing, breaking, or collapsing at these locations as a result of the higher stress levels.

The inclined lines of weakness 231/241 may also include a segment of the aforementioned tear lines of weakness 232/242, wherein the cut/land ratio (or average ratio) is higher than that of the compressive lines of weakness 233/243 and, optionally, the front panel lines of weakness 214. In one example, the length of the cuts on the tear lines of weakness 232/242 can be about 6.35 mm, and the length of the lands can be about 2 mm. In some examples, the cuts and lands can form an cut/land ratio of about 3.16 to about 3.18, or more specifically about 3.17 to about 3.18, or even more specifically, about 3.175. In some embodiments, the cut/land ratio (or average ratio) of the tear lines of weakness 232/242 can be generally twice as great as the cut/land ratio (or average ratio) of the compressive lines of weakness 233/243, the front panel score line lines of weakness 214, and/or the rear panel tear line of weakness 224. The higher cut/land ratio (or average ratio) of the tear lines of weakness. 232/242 can help a tear propagate along the inclined lines of weakness 231/241 without deviating away from the pattern 200 and causing unwanted tearing. This is because the larger cut/land ratio of tear lines of weakness 232/242 result in a line of weakness that is generally weaker and/or requires less force to rupture as compared to the compressive lines of weakness 233/243 and/or the lines of weakness 214 of the first side panel 110. In some situations, it may be desirable to have higher degree of weakness along a stretch of the panels 130 and 140 of the carton 100, as it can be otherwise difficult to cause a tear to propagate along such a long side without deviating from the pattern 200.

The cut/land ratio (or average ratio) of the tear lines of weakness 232/242 can be similar to, greater than, or less than that of starter line of weakness 215. However, in at least one example, the cut/length ratio of tear lines of weakness 232/242 is lower than that of the starter line of weakness 215 so as to provide greater structural integrity along the side of the carton 100, and to provide a starter that initiates the line of weakness breaking with relative ease.

The second side panel 120 can optionally include a second side panel line of weakness 224. The second side panel line of weakness 224 runs generally horizontal across the second side panel 120 at a location at or around the lower boundary of the gusset portion 123. In some examples, second side panel line of weakness 224 has an cut/land ratio (or average ratio) similar to that of the front panel score lines of weakness 214 and the compressive lines of weakness 233/243 in that the ratio is generally lower than that of the tear lines of weakness 233/243 and the starter score line of weakness 215. In one example, the length of the cuts on the second side panel lines of weakness 224 can be about 3.18 mm, and the length of the lands can be about 2 mm. In some examples, the cuts and lands can form an cut/land ratio of about 1.45 to about 1.75, or more specifically about 1.55 to about 1.65, or even more specifically, about 1.59. Accordingly, the second side panel line of weakness 224 is relatively strong and can provide structural support to the second side panel 120 of the carton 100. The second side panel line of weakness 224 can be omitted if the carton 100 is configured for the top portion 102 to remain hinged instead of being removable. For example, the second side panel 120 can be configured such that the top portion 102 of the carton 100 remains attached by the second side panel 120 to the remainder of the carton 100 upon separation along the pattern 200.

In some embodiments, a cut 222 may extend across the first rear edge 122 of the rear panel 110. The cuts 222 can be configured to extend across the first rear edge in order to facilitate tearing around the corner of the carton 100 when assembled. Tearing the carton 100 across or around corners can be difficult and can often result in a tear propagating away from the score line. The cut 222 can therefore be configured to facilitate the tear to propagate along the pattern 200 by providing a point of weakness on the corner itself.

The size of the carton 100 and the panels forming the carton can take on various shapes, sizes, dimensions, and configurations. In one example, the carton 100 can have panels (e.g., front, rear, and side panels) that are about 160 to about 170 mm high in an unfolded configuration. More specifically, the height of the unfolded panels can be about 163 mm to about 164 mm. The width of the panels can also vary. For example, in one example, the each of the rear panel 130 and front panel 140 can have a similar or virtually identical width. Likewise, in the opposing first side panel 110 and second side panel 120 can also have a similar or virtually identical width. In some embodiments, the front and rear panels 130/140 are about 110 to 115 mm wide, or even more specifically, about 112 to about 113 mm wide. In some examples, the first side panel 110 and second side panel 120 are about 70 to 75 mm wide, or more specifically, about 72 to about 73 mm wide.

The specific embodiments described herein provides dimensions of the carton 100 and the pattern 200 that are configured to provide a dual-opening gable top carton 100 having sufficient strength, while also facilitating the dual-opening functionality. It should be appreciated that some dimensions described herein can be applied to cartons having other sizes, shapes, and/or configurations. For example, the cut/land ratios (or average ratios) of pattern 200 described herein may be applicable on cartons having other shapes and dimensions. Other dimensions, however, may vary as the size, shape, and configuration of the carton changes. For example, the angle $\alpha$ of the inclined lines of weakness 231/241 may vary depending on the widths of the panels of the carton. That is, cartons employing wider or narrower front and rear panels an angle $\alpha$ that is greater or less than that depicted, so as to account for the angle of the pull force vector applied to the carton.

While FIG. 5 shows a configuration of a blank 10 with the second front panel 140 on the left-most side of the sheet 10, and the second side panel 120 on the right-most side of the sheet 10, with the first side panel 110 and rear panel 130 positioned therebetween. It should be understood that other configurations of the blank 10 can be employed to form cartons consistent with the present disclosure. For example, in some aspects, the first side panel 110, second side panel 120, or the rear panel 130 could be positioned on the left-most edge of the sheet 10, provided that the sheet 10 can still be formed into the shape of a carton. Further, the flap portion 150 could extend from any of the first side panel 110, second side panel 120, or the front or rear 130/140. Moreover, while FIG. 5 shows first side panel 110 and second side panel 120 as having roughly the same width, and both front and rear panels 130/140 also having roughly the same width in order to fold into a carton having a rectangular shaped cross section, it should be appreciated that the sizes of these panels can vary so as to form cartons having cross sections of varying shapes. For example, in some embodiments, all sides could be of similar width to establish a carton having a square shaped cross section. In other embodiments, second side panel 120 may have a width greater than that of the first side panel 110 so as to establish a carton having a trapezoidal shaped cross section. Depending on the configuration and shape of the panels, various features of the carton 100 may be modified in order to obtain the benefits of the presently described technology. For example, depending on the dimensions of the panels, the angles of various portions of pattern 200 can vary to help ensure that the pull force vectors are applied along planes that are generally parallel to the pattern 200. Further, the configuration of the lines of weakness and the cut/land ratios can vary around the carton to accommodate changes in the shape of the carton.

In operation, a user wishing to remove the top portion 102 of an assembled carton 100 will start by bending starter 115 inwards with a finger or thumb by breaking starter score line of weakness 215 extending around the periphery of the starter 115. After breaking the starter 115, the user's thumb or finger can then pull outward and upward on the first side panel 110, whereby crease lines 116 and 118 on the front panel can allow first side panel 110 to bend, bow, or otherwise flex outward. This outward flexing can help the user's pulling force vectors run along a plane that is generally more parallel with the plane of pattern 200. Thus, the pull force vector can cause front panel score line lines of weakness 214 to break, thereby allowing the tear to propagate along pattern 200 up to corner portions 213 and 212. The user can continue to provide an outward and upward force at an angle that is generally sufficient to generate a force vector that runs relatively parallel to the plane of pattern 200. In this manner, angle $\alpha$ can be configured to align or to correspond with the angle of pull. The pull force vector can cause the tear to propagate along angled score line lines of weakness 231/241 on the front and rear panels 140/130. Accordingly, top portion 102 can be bent backward from the carton 100 as shown in FIG. 4. The top portion 102 can thereafter be removed from the carton 100 by breaking second side panel line of weakness 224. Additionally and/or alternatively, a user may elect to keep the top portion 102 attached to the carton 100 so as to subsequently re-over the carton 100 at a later time.

The pattern 200 preferably, though not necessarily, includes single cuts that extend across each of the front first side edge 114 and the rear first side edge 112, thereby extending around the corner of the carton 100. These cuts extending around the corners help propagate the tearing along the pattern 200 around the corners.

The first side panel 110 can include two crease lines, for example, front crease line 116 and ear crease line 118, which extend generally upward from the starter 115 toward the front first side edge 112 and rear first side edge 114, respectively, of the first side panel 110. The creases lines 116 and 118 allow the first side panel 110 to bend, bow, and/or flex after the starter 115 has been broken. For example, upon breaking of the starter portion, a user can pull on the top portion 102 of the carton 100 in an upward and/or outward direction using, a finger or thumb, thereby causing the first side portion to bend or flex in the direction of the pull. This bending or flexing allows the top portion 102 of the carton 100 to direct stress vectors along the pattern 200 of lines of weakness. Directing stress vectors along the pattern, and generally along a plane that is close to parallel with the pattern 200, helps propagate the tearing without branching off in an undesired direction.

The carton 100 described herein can be configured for stackability on a shelf while on display for retail sale, for example, in a supermarket. The cartons 100 can be stacked while remaining inside the bottom portion of a corrugated shipper. For example, the presently described cartons 100 can be shipped with several cartons 100 in a single corrugated shipper box. After arrival at a retail store, the upper portion of the corrugated shipper box can be removed so that the cartons 100 remain in the bottom portion of the box. Two such corrugated boxes filled with cartons 100 can then be placed one on top of another for display on a retail shelf. In this manner, the tops of the gable top cartons 100 support the bottom portion of the top stacked corrugated shipper box. Because this stacking can create pressure points on the bottom cartons, the stress can result in unwanted tearing, breaking, or collapsing of the cartons. The presently described cartons are therefore configured to provide points of strength that mitigate this unwanted tearing, breaking, and/or collapsing, while also maintaining the ability of the cartons to easily and readily offer dual-opening functionality.

The term "line of weakness" as used herein is not limited to the specific examples described and illustrated, as a line of weakness can take different forms. For example, a line of weakness can be formed from a perforation pattern (such as with through cuts spaced by lands), a score pattern (such as with partial depth cuts optionally spaced by lands), thinned die lines, and the like that provide a weakened line as compared to the portions of the material immediately adjacent the weakened line, and the line does not have to be a linear line or continuous line. Moreover, the weakening does not have to be only on one side or the other, e.g., the inner facing side or outer facing side of a panel. The weakening can include, for example, half or otherwise partial depth cuts on either the inner facing side, the outer facing said and/or a combination thereof, such as if a line of weakness were formed of a perforation pattern with the cuts being a partial depth cut alternating between the inner and outer facing sides.

The drawings and the foregoing descriptions are not intended to represent the only forms of the carton in regard to the details of construction. Changes in form and in proportion of parts, as well as the substitution of equivalents, are contemplated as circumstances may suggest or render expedient.

The invention claimed is:

1. A dual-opening carton comprising:

a front panel, a rear panel opposite the front panel, and first and second side panels each extending between the front and rear panels;

a flap at a top of the front panel being attached to the rear panel to close a top end of the carton, the flap being at least partially detachable from the rear panel along one or more flap lines of weakness to open the top end of the carton to access contents of the carton; and a pattern of panel lines of weakness extending about the front, rear first side and second side panels, the pattern being configured to be ruptured to permit a top portion of the carton to be at least partially removed to access contents of the carton, the pattern including:

one or more first side panel lines of weakness extending toward the front panel and toward the rear panel; and an inclined line of weakness in each of the front and rear panels and aligned with ends of the first side panel lines of weakness, the inclined lines of weakness each being closer to the top of the carton adjacent the second side panel as compared to adjacent the first side panel, wherein the inclined line of weakness in each of the front and rear panels is configured to require a lower force to rupture as compared to the one or more first side panel lines of weakness.

2. The carton of claim 1, further comprising a starter line of weakness extending around at least a portion of a periphery of a starter portion in the first side panel; and wherein the one or more first side panel lines of weakness comprises a pair of first side panel lines of weakness, one extending from adjacent one end of the starter line of weakness toward the front panel and the other extending from adjacent the other end of the starter line of weakness toward the rear panel.

3. The carton of claim 2, wherein the starter line of weakness is configured to require a lower force to rupture as compared to the pair of first side panel lines of weakness.

4. The carton of claim 3, wherein the starter line of weakness is configured to require a lower force to rupture as compared to the inclined line of weakness in each of the front and rear panels.

5. The carton of claim 4, wherein the pattern of panel lines of weakness is formed from a series of cuts and lands.

6. The carton of claim 5, wherein a cut of the pattern extends across an intersection of the front and first side panels, and another cut of the pattern extends across an intersection of the rear and first side panels to facilitate tearing along the pattern from the first side panel to the front and rear side panels.

7. The carton of claim 5, wherein an average length of the cuts of each of the pair of first side panel lines of weakness is less than an average length of the cuts of each of the inclined lines of weaknesses.

8. The carton of claim 7, wherein an average length of the cuts of the starter portion line of weakness are greater than the average length of the cuts of each of the inclined lines of weaknesses.

9. The carton of claim 5, wherein the length of the cuts of each of the inclined lines of weakness is greater adjacent the first side panel as compared to the second side panel.

10. The carton of claim 5, wherein each of the pair of first side panel lines of weakness has a first average ratio of lands to cuts, the starter line of weakness has a second average ratio of lands to cuts, and each of the inclined lines of weakness has a third average ratio of lands to cuts, and wherein the first and third ratios are different.

11. The carton of claim 10, wherein the first ratio is larger than the third ratio.

12. The carton of claim 10, wherein the first, second and third ratios are different.

13. The carton of claim 12, wherein the first ratio is larger than the second ratio.

14. The carton of claim 13, wherein the third ratio is less than the first ratio.

15. The carton of claim 2, wherein each of the pair of first side panel lines of weakness is inclined toward the top of the carton and away from the starter line of weakness.

16. The carton of claim 1, wherein the first side panel has a pair of crease lines, one of the crease lines extending from adjacent one end of the starter line of weakness toward the top of the carton and the other of the crease lines extending from adjacent the other end of the starter line of weakness, the crease lines configured to facilitate flexing of the front and rear panels toward each other during removal of the top portion of the carton.

17. The carton of claim 1, wherein the inclined lines of weakness are each straight lines inclined toward the top of the carton by an angle of greater than 15 degrees.

18. The carton of claim 1, wherein the second side panel has a second side panel line of weakness such that the pattern permits the top portion of the carton to be entirely removed.

19. A method of opening the carton of claim 1, the method comprising opening the carton by breaking the flap lines of weakness and then moving the front and rear panels away from each other at top ends thereof.

20. A method of opening the carton of claim 1, comprising at least partially removing the top portion of the carton by propagating a tear along the pattern of lines of weakness.

* * * * *